US006126259A

United States Patent [19]

Stango et al.

[11] Patent Number: 6,126,259

[45] **Date of Patent: *Oct. 3, 2000**

[54] METHOD FOR INCREASING THE THROW DISTANCE AND VELOCITY FOR AN IMPULSE INK JET

[75] Inventors: Christopher M. Stango, Oakville; Norma J. Miller, New Milford; Robert L. Rogers, Sandy Hook, all of Conn.; Charles S. Tamarin, New Rochelle, N.Y.

[73] Assignee: Trident International, Inc., Brookfield, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/823,718

[22] Filed: Mar. 25, 1997

[51] Int. Cl.[7] ..... B41J 29/38

[52] U.S. Cl. ..... 347/9

[58] Field of Search ..... 347/9–11, 20

[56] References Cited

U.S. PATENT DOCUMENTS

| | | | |
|---|---|---|---|
| 4,104,646 | 8/1978 | Fishbeck | 347/11 |
| 4,459,601 | 7/1984 | Howkins | 347/68 |
| 4,491,851 | 1/1985 | Mizuno et al. | 347/11 |
| 4,509,059 | 4/1985 | Howkins | 347/10 |
| 4,523,200 | 6/1985 | Howkins | 347/11 |
| 4,523,201 | 6/1985 | Liker | 347/11 |
| 4,563,689 | 1/1986 | Murakami et al. | 347/11 |
| 4,646,106 | 2/1987 | Howkins | 347/9 |
| 4,686,539 | 8/1987 | Schmidle et al. | 347/11 |
| 4,697,193 | 9/1987 | Howkins | 347/9 |

*Primary Examiner*—N. Le
*Assistant Examiner*—Charlene Dickens
*Attorney, Agent, or Firm*—Woodcock Washburn Kurtz Mackiewicz & Norris LLP

[57] ABSTRACT

An impulse fluid jet apparatus having pulse generating circuitry for an impulse jet. The circuitry generates driving a longer pulse exciting the resonant frequency of the jet and a shorter pulse for exciting a higher harmonic frequency of the jet. The longer pulse changes the state of energization of the transducer in the jet to eject a droplet of fluid and the shorter pulse changes the state of energization so as to break off the tail of the droplet.

20 Claims, 4 Drawing Sheets

METHOD FOR INCREASING THE THROW DISTANCE AND VELOCITY FOR AN IMPULSE INK JET

FIELD OF THE INVENTION

This invention relates to drop-on-demand or impulse fluid jets which eject a droplet of fluid such as ink in response to energization of a transducer which may take various forms.

BACKGROUND OF THE INVENTION

Impulse fluid or ink jets are designed and driven so as to eject a droplet of fluid such as ink from the chamber through an orifice of the ink jet device. In many applications, it is not necessary to operate the ink jet device at high performance levels, i.e., at high velocities and long throw distances. However, many applications including industrial applications require high performance ink jet devices.

For example, in various industrial ink jet applications, it is very important to eject droplets at high velocities with long throw distances so as to reach targets some distance from the ink jet orifice while maintaining a relatively small droplet size to create a high resolution dot on the target itself. In order to achieve this result, it is important that the head of the droplet as well as its tail remain attached to each other and travel at the same relatively high velocity.

In the prior art, it has been difficult to achieve high velocity and long throw distances. For example, with expanding piezoelectric transducers in ink jet print heads of the type disclosed in U.S. Pat. No. 4,646,106, high performance is achieved in terms of frequency response using fluidic Helmholtz frequencies of from 25 to 50 kHz and comparable piezoelectric length mode resonant frequencies. However, the droplets formed have long tails which tend to lower the droplet velocity and the throw distance thus precluding optimum performance.

U.S. Pat. Nos. 4,523,201 and 4,523,200 disclose similar print heads driven by voltage waveforms having a first pulse of longer duration and a second pulse of shorter duration designed to achieve early break off of the droplet tail. However, the devices disclosed therein are designed to operate at Helmholtz frequencies of less than 50 kHz and there is no disclosure of the effect of exciting higher harmonic frequencies to achieve break off of the tail for producing higher velocity droplets with improved throw distance. Rather the second pulse merely improves aiming.

Reference is now made to FIGS. 1A through 1F which schematically depict the drive waveform in FIG. 1A and the ink jet device itself at various points in time in FIGS. 1B through 1F. Referring to FIG. 1A, the drive waveforms depicted with voltage on the ordinate and time on the abscissa. At time A, the ink jet device as depicted in FIG. 1B is maintained in the quiescent state with the transducer 10 unenergized and a predetermined volume of ink 12 contained within the chamber 14 behind an orifice 16. At time B as shown in FIG. 1A, the transducer 10 is driven by the voltage pulse 17 as shown so as to contract the length of the transducer 10 thereby increasing the volume of ink 12 within the chamber 14 and pulling back the meniscus 18 in the orifice 16 to the position shown.

As shown in FIG. 1C, which corresponds to time C of FIG. 1A, the transducer 10 begins to expand as the voltage is reduced as applied to the transducer 10. As a result, the volume of ink 12 within the chamber 14 begins to contract while advancing the meniscus 18 through the orifice 16 as shown in FIG. 1D. At a slightly later time than C but before D as shown in FIG. 1E, the transducer 10 has nearly returned to the quiescent state as shown in FIG. 1E and a droplet 20 with a ligament 21 has begun to form at the orifice 16. In FIG. 1F which corresponds to time D in FIG. 1A, the droplet 20 has traveled some distance from the orifice 16 with a slowly moving tail 22 attached. As depicted in FIG. 1F, the tail 22 has just broken off from the meniscus 18 at the orifice 16 before the volume of ink within the chamber 14 returns to the condition shown in FIG. 1B. As can be readily seen from FIG. 1F, the tail 22 is elongated in a manner so as to create a "lay over" condition on a target assuming the tail 22 and the head 20 remain attached throughout their flight to the target. Tail 22 which is relatively slow moving as compared to the head velocity which makes the tail grow in length and break up thereby decreasing the overall throw distance to the target.

In the devices of the prior art of the type disclosed in U.S. Pat. Nos. 4,459,601, 4,509,059, 4,646,106 and 4,697,193, ink jet devices have been characterized by Helmholtz resonant frequencies of approximately 40 kHz and piezo length mode resonant frequencies of 45 kHz. The tail which was formed at the meniscus saw pressure disturbances of approximately 45 kHz. As a consequence, the tail would be broken off as shown in FIG. 1F in response to this disturbance during the negative velocity part of the cycle so as to provide a very low acceleration component thereby producing a drop with a high head velocity and low tail velocity and a tail that grows longer over long print gaps producing poor print quality.

SUMMARY OF THE INVENTION

In accordance with this invention, a high performance fluid jet method and apparatus is provided wherein high velocity droplets are ejected from the fluid jet device.

In further accordance with the invention, a high performance fluid jet method and apparatus are provided wherein the droplets have a large throw distance to the target.

In further accordance with the invention, the method of operating an impulse fluid jet device is provided wherein the device comprises a chamber and an orifice for ejecting droplets from the chamber and a transducer having a resonant frequency and a higher harmonic frequency. The method comprises the steps of generating one energy pulse of one duration coupled to the transducer for exciting the resonant frequency of the transducer. Droplet ejection is initiated such that the droplet has a head and a tail attached in response to the one energy pulse. Another energy pulse of another duration is also generated and coupled to the transducer, the other energy pulse having substantially shorter duration than the one energy pulse for exciting a higher harmonic frequency. The attached tail is broken off from the head of the droplet in response to the other energy pulse. As a result, the head and the remainder of the tail travel together toward a target.

In one preferred embodiment of the invention, the other pulse follows the one pulse in time. In another preferred embodiment of the invention, the other pulse precedes the one pulse in time.

In accordance with another important aspect of the invention, the droplet of fluid or ink including the head and the attached tail comprise at least 20 picoliters and preferably more than 60 picoliters, preferably travel at a velocity in excess of 6 meters per second, and preferably have a travel distance or throw distance of at least 0.25 inches and preferably more than 0.5 inches.

In accordance with a further important aspect of the invention, the transducer has a resonant frequency in excess of 50 kHz and preferably in excess of 75 kHz and a higher harmonic in excess of 150 kHz and preferably in excess of 200 kHz.

In accordance with another important aspect of the invention, the fluid or ink jet chamber is of a volume so as to preferably have a Helmholtz frequency in excess of 50 kHz.

In the preferred embodiment, the duration of the one pulse is greater than 5 microseconds but less than 100 microseconds and the duration of the other pulse is greater than 0.5 microseconds but less than 6 microseconds. The time delay between the one pulse and the other pulse is greater than 1 microsecond but less than 5 microseconds.

BRIEF DESCRIPTION OF THE DRAWINGS

FIG. 2A' is an alternative waveform for driving a fluid or ink jet device in accordance with another preferred embodiment of the invention.

DETAILED DESCRIPTION OF THE PREFERRED EMBODIMENTS

Figure 1A:
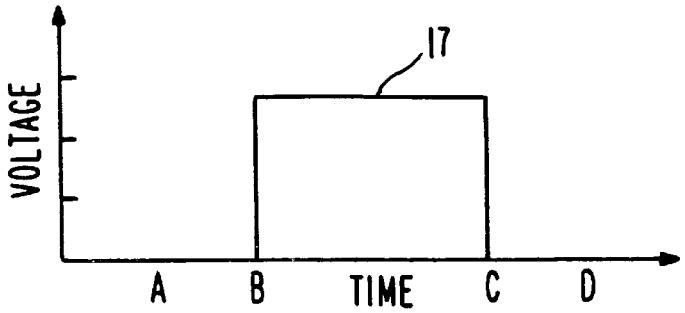
PRIOR ART Fig. 1A
FIGS. 1A through 1F are diagrammatic, partially schematic representations of the prior as discussed above.
Figure 1B:
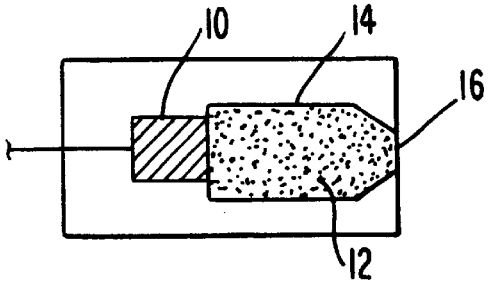
PRIOR ART Fig. 1B
Figure 1C:
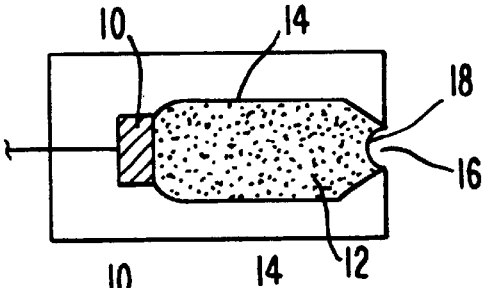
PRIOR ART Fig. 1C
Figure 1D:
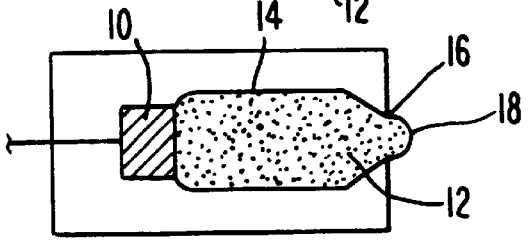
PRIOR ART Fig. 1D
Figure 2A:
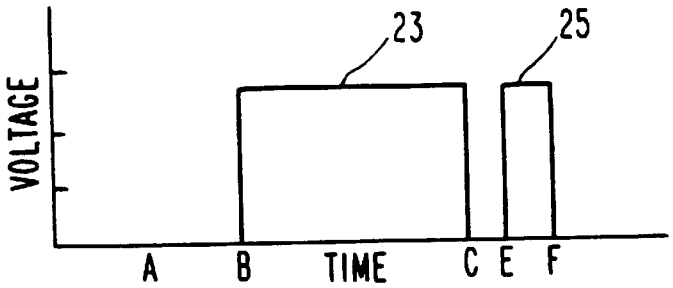
FIG. 2A is a waveform for driving a fluid or ink jet device in accordance with the invention.
Figure 2A:
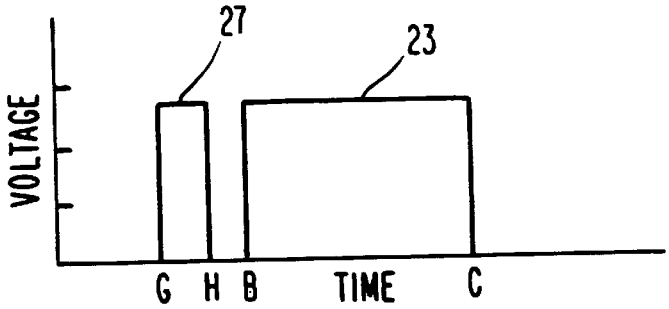

Reference will now be made to FIG. 2A wherein a piezoelectric transducer voltage drive waveform is shown in accordance with one preferred embodiment of the invention. One pulse 23 after time A and between times B and C is generated and applied to the piezoelectric transducer so as to contract the transducer as shown in FIGS. 1B and 1C. However, unlike the prior art voltage waveform of FIG. 1A, another pulse of shorter duration immediately follows the one pulse beginning at time E and terminating at time F. In accordance with this invention, the one pulse between times B and C excites the piezo resonant frequency, while the other shorter pulse between times E and F excites a higher harmonic frequency of the piezoelectric transducer. This higher harmonic frequency has a high acceleration component and enough amplitude to disturb the tail formation seen in the prior art representation of FIG. IF as will now be described with reference to FIGS. 2B and 2C.

Figure 1E:
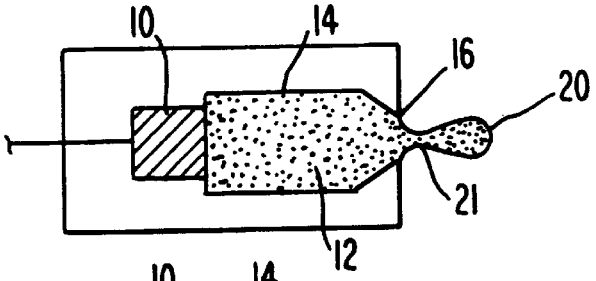
PRIOR ART Fig. 1E
Figure 1F:
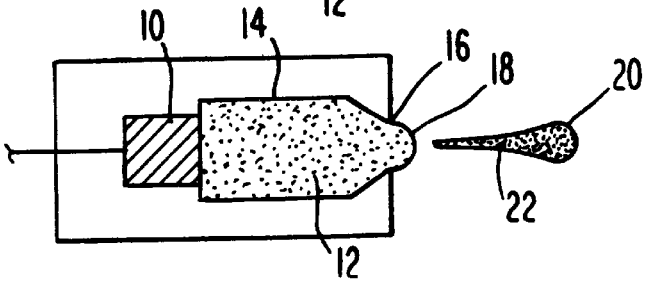
PRIOR ART Fig. 1F
Figure 2B:
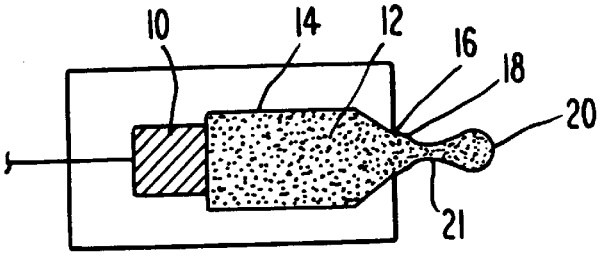
FIG. 2B is a partially schematic representation of a fluid or ink jet device in accordance with this invention being driven by the waveform of FIG. 2A or FIG. 2A' as the droplet emerges from the ink jet device.
Figure 2C:
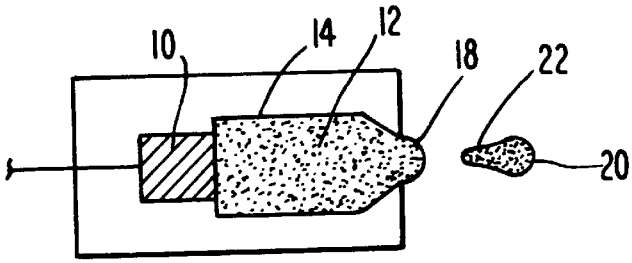
FIG. 2C is a partially schematic representation of a fluid or ink jet device which represents the device of FIG. 2B at a slightly later point in time.

As shown in FIG. 2B, the pulse 23 between times B and C forces the droplet 20 connected to the ink 12 within the chamber 14 outwardly from the orifice 16 similar to that shown in the prior art FIG. 1E. However, the shorter pulse 25 between times E and F as shown in FIG. 2A excites a higher harmonic of the piezo resonant frequency so as to interrupt the formation of an elongated tail from the ligament 22 as shown in FIG. 2B creating a more nearly spherical droplet 20 as shown in FIG. 2C with only an abbreviated tail 22 as contrasted with the elongated tail 22 shown in FIG. 1F.

In accordance with this invention, the piezoelectric transducer 10 is chosen so as to have a high resonant frequency. The resonant frequency of the transducer 10 is in excess of 50 kHz and preferably greater than 75 kHz with 90–300 kHz being preferred and representing the preferred embodiment. The higher harmonic frequency which is excited by the trailing pulse between times E and F is in excess of 150 kHz with frequencies in excess of 200 kHz preferred and 235 kHz utilized in the preferred embodiment. For the preferred embodiment were the resonant frequency is 90–300 kHz and the higher harmonic is 235–800 kHz, the pulse 23 between times B and C is preferably 14.5 microseconds which pulls the ink back in the meniscus 18 to the position shown in prior art FIG. 1C. The pulse 23 between times B and C is followed by a dead time between time C and E which is preferably 1.5 microseconds followed by the shorter pulse 25 between times E and F of 3.0 microseconds in duration so as to excite the higher harmonic of 235 kHz. This higher harmonic resonant of frequency of 235 kHz creates a pressure wave with a high acceleration component that disturbs the ink flow in the orifice as the ink flows out as discussed above. Tail formation as a consequence is greatly affected such that the tail breaks off from the meniscus 18 much earlier than in the single pulse approach of the prior art. The shorter tail 22 can now travel with the head of the drop 20 because the liquid surface tension is now high enough to keep the drop together and accelerate the shorter tail to the same velocity as the head of the drop.

In accordance with another important aspect of the invention, increasing the fluidic resonant frequency improves throw distance of the drops. For example, increasing the fluidic resonant frequency or Helmholtz frequency from 45 kHz to 90 kHz and correspondingly increasing the natural ringing frequency of the transducer from 45 kHz to 90 kHz can in of itself increase the drop tail velocity from 4.5 meters per second to 5.5 meters per second with the head traveling at 6.5 meters per second so as increase the throw distance of the drop at least 75 percent. With the addition of another pulse with a short duration so as to excite the higher harmonic resonant frequency such as for example 235 kHz, the tail of the drop may be broken off sufficiently earlier so as to increase the tail velocity to 6.5 to 7 meters per second. This produces ink drops with throw distances increased by as much as 200 percent.

It will be appreciated that the same higher harmonic frequencies which achieve early droplet break off and shorter tails may be achieved by the use of a shorter pulse before or after a longer pulse. As shown in FIG. 2A', a shorter pulse 27 between times G and H precedes the longer pulse between times B and C. The effect is the same since the shorter pulse 27 following the longer pulse 23 is capable of exciting the higher harmonic frequency, i.e. a frequency in excess of 150 kHz and as high as 235 kHz in the preferred embodiment.

Figure 3:
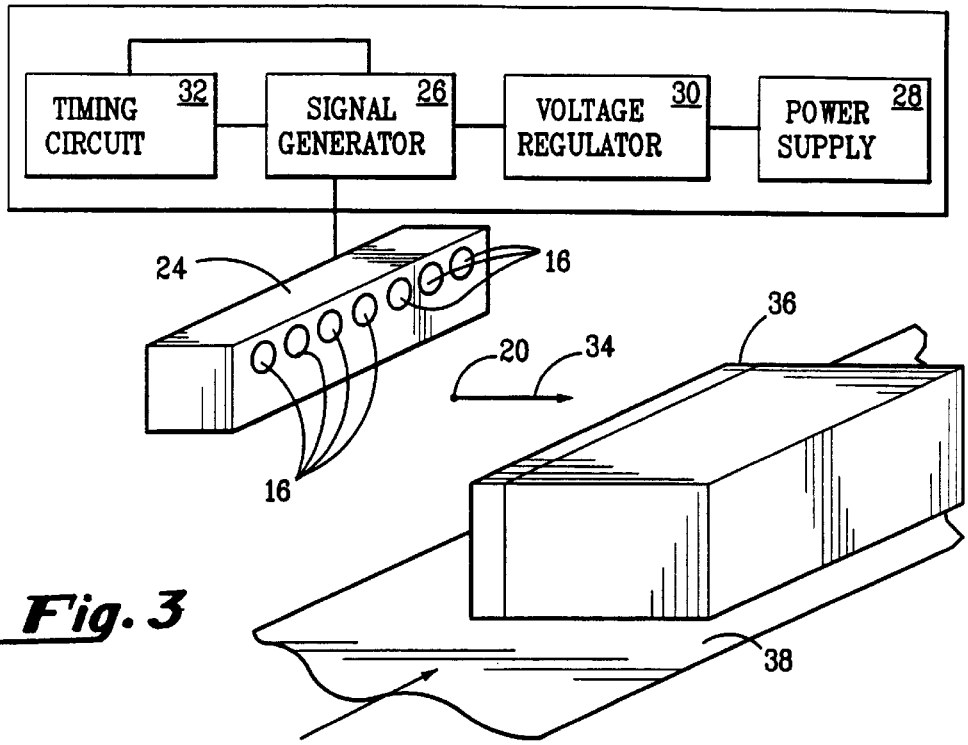
FIG. 3 is a partially schematic/block diagram of an jet printing apparatus which may be utilized in practicing the invention.

Referring to FIG. 3, a system is shown including a plurality of fluid or jet devices of the type shown in FIG. 2B and 2C incorporated in a head 24 with orifices 16 shown of exaggerated size. The head 24 is driven by a signal generator 26 connected to a power supply 28 and a voltage regulator 30. A timing circuit 32 is coupled to the signal generator so as to generate voltage drive pulses for the transducers of the fluid or ink jet devices incorporated in the head 24 which include a longer pulse of the type described above as well as a shorter pulse which may precede or follow the longer pulse.

As shown in FIG. 3, a droplet 20 is being ejected in a direction indicated by the arrow 34 toward a target or object 36 carried by a conveyor 38. In many applications, it may be desirable or necessary to separate the head 24 from the target 36 by some distance. It is therefore important to achieve long throw distances and high drop velocity with little or no tail in order to achieve high resolution drop and accuracy in accordance with this invention.

It should also be appreciated that the invention is not limited to any particular type of wave shape. As shown in FIG. 4, the wave shape need not be square or rectangular but may be almost sawtoothed and the voltage level between the longer pulse 37 and the shorter pulse 39 need not go to zero but need only to have a substantially lesser amplitude than the peaks of the longer pulse and the shorter pulse. In this regard, the longer pulse 37 between times I and J shown in FIG. 4 is almost triangular as is the shorter pulse 39 between times K and L. Moreover, the time separating the longer pulse and the shorter pulse between times J and K is characterized by a non-zero varying voltage as is the voltage following the shorter pulse between time K and L. The overall effect is to excite the natural ringing or resonant frequency of the piezo transducer with the longer pulse 37 between times I and J and the higher harmonic with the shorter pulse between times K and L. Of course, as indicated previously, the shorter pulse may precede or follow the longer pulse using the wave forms of FIG. 4. Alternate pulses 37*a* and 37*b* are shown in FIG. 4*a* where the shorter pulse follows the longer pulse.

As indicated previously, the preferred embodiment, whether utilizing the wave form of FIGS. 2A, 2A', 4 or 4A, provides for a longer pulse of 14.5 microseconds and a shorter pulse 3.0 microseconds. Other embodiments, depending upon the resonant frequency of the transducer, may incorporate other durations. For example, the pulse of the longer duration may be between 5 microseconds and 100 microseconds whereas the pulse of the shorter duration may be between 0.5 microseconds and 6 microseconds. Similarly, time between pulses may vary between 0.1 microsecond and 5 microseconds.

Figure 4:
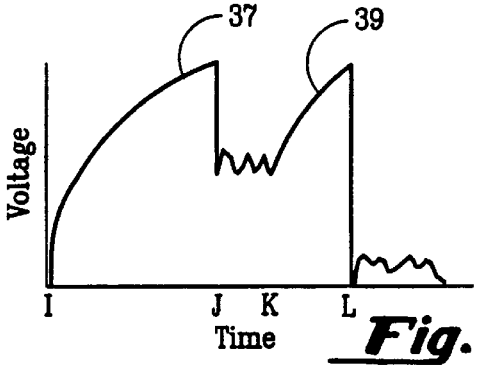
FIG. 4 is an alternative voltage waveform which may be used in another embodiment of the invention.
Figure 5:
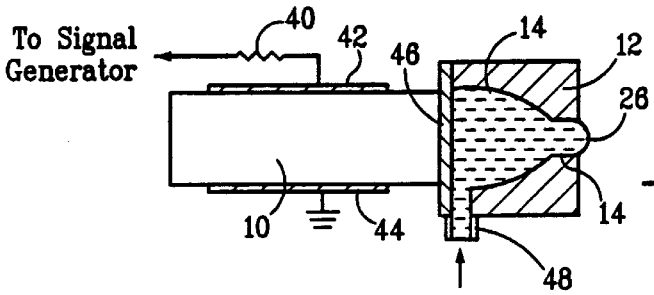
FIG. 5 is a circuit diagram depicting a resistor in series with a length mode piezoelectric electric transducer driven by the signal generator of FIG. 3 using the various waveforms contemplated by this invention.

Referring again to FIG. 4, the waveform described therein is particularly desirable to achieve stable performance. In order to achieve the waveform of FIG. 4, it would be desirable to include a resistance in series with the piezoelectric transducer. In this regard, reference is made to FIG. 5 wherein a resistor 40 of at least 100 ohms is connected in series with a transducer 10 located between an electrode 42 and an electrode 44. As shown, the transducer 10 is a length mode transducer which achieves the transducer expansion and contraction shown in FIGS. 2B and 2C and has a length less than 0.6 inches. The transducer 10 is coupled to the chamber 14 through a diaphragm 46. An inlet 48 leading into the chamber 14 is also shown. In the preferred embodiment, the chamber 14 would have a sufficiently small volume so as to assure a high Helmholtz resonant frequency in excess of 50 kHz and preferably approaching 90 kHz and would be embodied in the printhead shown in U.S. Patent Application Ser. No. 08/828,758 filed Feb. 25, 1997 (Attorneys Docket No. TRID-0100) which is incorporated by reference. Further details concerning the particular impulse ink jet disclosed in FIG. 5 may be found with reference to U.S. Pat. No. 4,697,193 which is incorporated herein by reference although it will be understood that Helmholtz frequencies in excess of 50 kHz are not disclosed in the aforesaid patent.

Figure 4A:
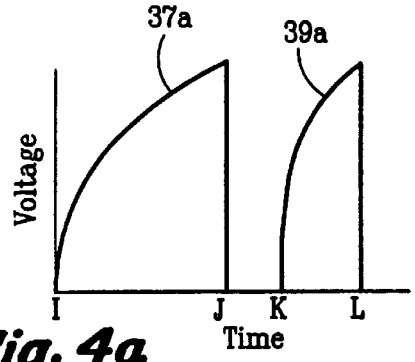
FIG. 4*a* is yet another alternative waveform which may be used.
Figure 6:
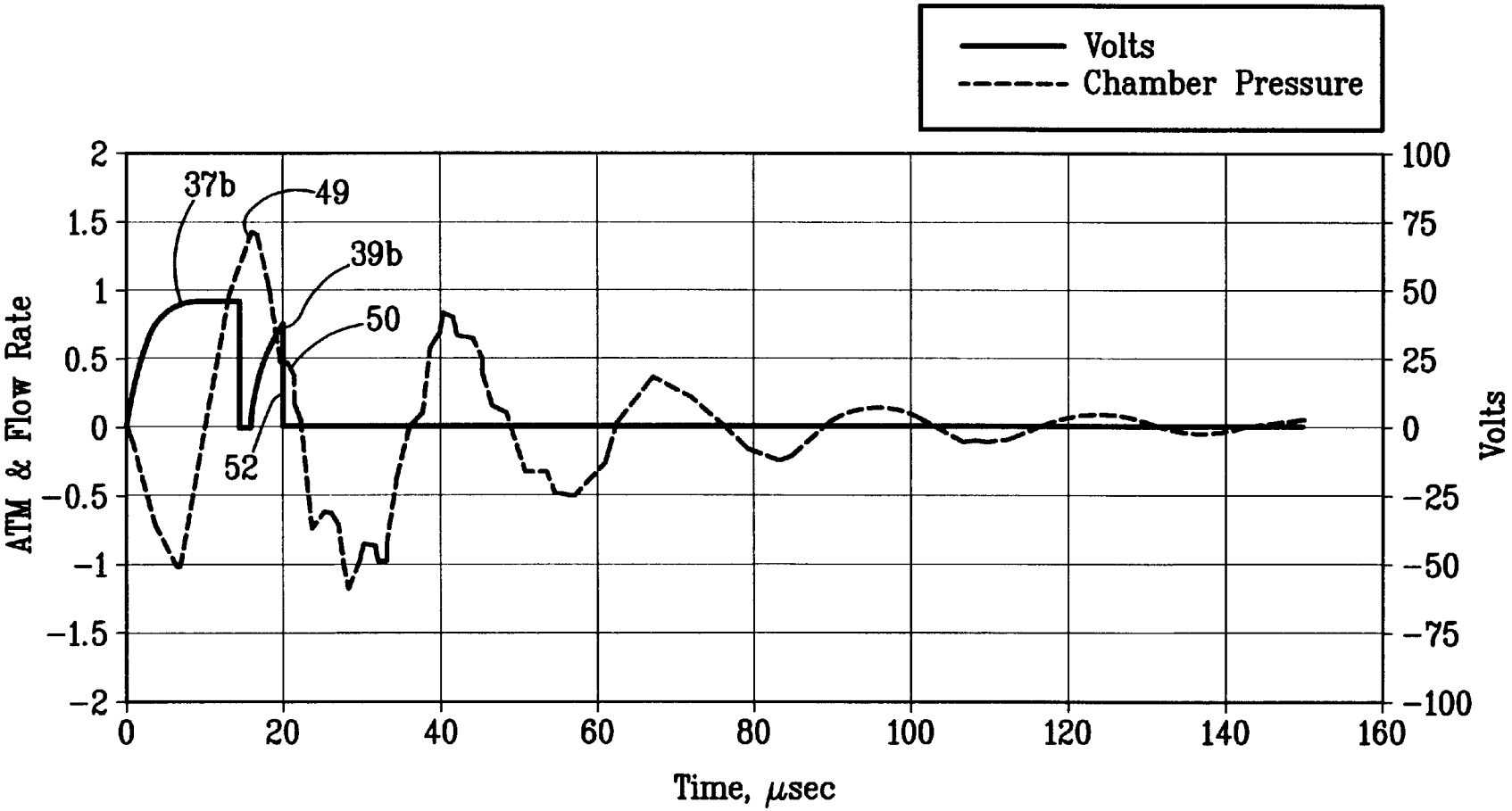
FIG. 6 depicts the resonant frequency of the transducer and a higher harmonic superimposed on drive waveforms which achieve a droplet having a high velocity with a long throw distance.

As shown in FIG. 6, a voltage waveform similar to that shown in FIG. 4*a* is superimposed on the chamber pressure of the fluid jet device depicted in FIGS. 2B and 2C. It will be noted that the chamber pressure variation corresponding to the resonant frequency of the device is basically sinusoidal and decaying as a result of the longer pulse 37*b* but carries a slight ripple as a result of the shorter pulse 39*b* which excites the higher harmonic of the device. The ripple which corresponds to the higher harmonic of the device takes the shape of a step 50 coinciding with the trailing edge 52 of the shorter pulse 39*b* actually causes the tail of the droplet to break off to create a smaller droplet as shown in FIG. 2C. As a result, the droplet is able to travel further at higher velocities; i.e., the throw distance is increased.

It will be appreciated that the higher harmonic frequency of the transducer must be excited in a way so as to assure that the tail of the droplet is accelerated into the droplet and not decelerated. In order to depict the proper relationship between the resonant frequency of the transducer and the higher harmonic frequency, reference is made to FIG. 6 wherein the resonant frequency corresponds to the generally sinusoidal wave shape 49 and the higher harmonic frequency corresponds to the generally sinusoidal wave shape 50 properly phased by the timing of the pulses such that a specific high harmonic frequency is excited. This relationship between the higher harmonic and the resonant frequency will assure that the tail is broken off and the remainder of the tail which stays with the droplet will be accelerated into the droplet head thereby improving throw distance and velocity.

Although particular transducers and particular voltage waveforms have been shown, it will be appreciated that this invention may be practiced with a variety of devices including bubble jets where the fluid or ink itself serves as a transducer. In addition, the invention may be practiced with other shapes and forms of transducers, i.e., not necessarily length mode expander transducers. For example, benders and shared wall transducers may be used. Moreover, the particular drive waveform may not be a voltage but any energy pulse so as to energize and deenergize the transducer at the appropriate times to assure the excitation of the resonant frequency as well as the higher harmonic frequency. Finally, the fluid need not be ink but may comprise any liquid which must be jetted in droplet form for any purpose, e.g. metering.

What is claimed is:

1. A method of operating an impulse fluid jet device comprising a chamber having an orifice for ejection of droplets, said method comprising the following steps:

providing a transducer having a resonant frequency and a higher harmonic frequency;

generating a first energy pulse having a first duration and a waveform sufficient to energize the transducer, thus exciting the resonant frequency of the transducer and initiating the ejection of a drop of fluid from the orifice, said drop having a head portion and attached tail portion, wherein the droplet tail portion is integral with fluid at the orifice;

generating a second energy pulse having a second duration substantially shorter than said first duration and a waveform sufficient to energize the transducer, thus exciting the higher harmonic;

wherein the higher harmonic generates a pressure wave, such that the tail portion breaks from the fluid at the orifice and the tail portion and the head portion of the drop travel at substantially the same velocity toward a target.

2. The method of claim 1 further comprising providing said device with a Helmholtz fluidic frequency in excess of 50 kHz.

3. The method of claim 1 wherein said step of providing said transducer comprises providing said transducer having said resonant frequency greater than 75 kHz and said higher harmonic greater than 200 kHz.

4. The method of claim 1 wherein said step of generating said first energy pulse comprises generating said first energy pulse having said first duration between 5 μsec and 100 μsec and said step of generating said second energy pulse comprises generating said second energy pulse having said second duration between 0.5 μsec and 6 μsec.

5. The method of claim 1 wherein the resonant frequency of the transducer is in excess of 50 kHz.

6. The method of claim 1 wherein the higher harmonic frequency of the transducer is in excess of 150 kHz.

7. The method of claim 1 wherein the first duration of greater than 5 μsec.

8. The method of claim 1 wherein the second duration is greater than 0.5 μsec.

9. The method of claim 1 further comprising the step of waiting a period of time between generating the first and second pulses.

10. The method of claim 9 wherein the waiting period is at least 0.1 μsec.

11. The method of claim 9 wherein the waiting period is between 0.1 μsec and 5 μsec.

12. An impulse fluid jet apparatus comprising:

a fluid jet chamber having an orifice;

a length mode expander piezoelectric transducer coupled to said fluid jet chamber so as to expand therein, said transducer having a resonant frequency and a higher harmonic frequency;

pulse generating circuitry coupled to the transducer for changing the state of energization of the transducer for generating pulses which eject drops of fluid from the orifice on demand, wherein said circuitry generates a first pulse having a first duration thus exciting said resonant frequency and initiating the ejection of a drop of fluid, said drop having a head portion and an attached tail portion, the drop tail portion being integral with fluid at the orifice, and wherein said circuitry generates a second pulse having a duration substantially shorter than said first pulse, thus exciting said higher harmonic frequency and generating a pressure wave that breaks the tail portion of the drop from said fluid at the orifice, such that the tail portion and the head portion travel at substantially the same velocity toward a target.

13. The apparatus of claim 12 wherein the second pulse preceded the first pulse in time.

14. The apparatus of claim 12 wherein said pulse generating circuitry generates said first pulse having a duration between 5 μsec and 100 μsec and said second pulse having a duration between 0.5 μsec and 6 μsec.

15. The apparatus of claim 12 wherein said pulse generating circuitry includes a resistance in series with said transducer of at least 100 ohms, such that the waveform of the second pulse is sufficiently square to excite the higher harmonic frequency generating the pressure wave.

16. The apparatus of claim 12 wherein the resonant frequency of the transducer is in excess of 50 kHz.

17. The apparatus of claim 12 wherein the higher harmonic frequency of the transducer is in excess of 150 kHz.

18. The apparatus of claim 12 wherein the first duration is greater than 5 μsec.

19. The apparatus of claim 12 wherein the second duration is greater than 0.5 μsec.

20. The apparatus of claim 12 wherein said circuitry creates a time delay between the first and second pulses of at least 0.1 μsec.

* * * * *